United States Patent [19]

Ellis

[11] Patent Number: 4,911,391

[45] Date of Patent: Mar. 27, 1990

[54] PEDESTAL BASE

[75] Inventor: M. Jeffrey Ellis, Wesley Hills, N.Y.

[73] Assignee: Henschel-Steinau, Inc., Englewood, N.J.

[21] Appl. No.: 380,661

[22] Filed: Jul. 17, 1989

[51] Int. Cl.[4] ..... A47B 91/00

[52] U.S. Cl. ..... 248/188.7; 248/165

[58] Field of Search ..... 248/163.1, 165, 166, 248/434, 435, 188.7, 523, 158; 108/150, 153; 211/189, 205; 403/176, 175, 217

[56] References Cited

U.S. PATENT DOCUMENTS

| | | | |
|---|---|---|---|
| 2,055,761 | 9/1936 | Gerschefski | 248/165 |
| 3,863,876 | 2/1975 | Finkelstein | 248/158 X |
| 3,877,669 | 4/1975 | Ambasz | 248/188.7 |
| 4,084,776 | 4/1978 | Cook | 403/175 X |
| 4,159,096 | 6/1979 | Chase | 248/523 |
| 4,178,858 | 12/1979 | Ponzellini | 108/153 X |
| 4,728,067 | 3/1988 | Steinmetzer | 248/163.1 X |

FOREIGN PATENT DOCUMENTS

| | | | |
|---|---|---|---|
| 2342915 | 8/1973 | Fed. Rep. of Germany | 248/188.7 |

*Primary Examiner*—J. Franklin Foss

*Attorney, Agent, or Firm*—Samuelson & Jacob

[57] ABSTRACT

A pedestal base is assembled from a central post and radially extending legs, each leg having a hub portion including a hub segment, a hub sector and a groove segment between the hub segment and the hub sector such that upon abutment of the hub portions into a full cylindrical hub configuration, the central post is inserted into the groove established by the groove segments and locked in place to secure the hub portions in the full cylindrical hub configuration and the central post within the full cylindrical hub configuration without further supplemental fastener elements.

11 Claims, 2 Drawing Sheets

PEDESTAL BASE

The present invention relates generally to stands and pertains, more specifically, to display stands of the type having a readily assembled construction which includes a pedestal base.

Display stands have become a staple in the presentation of items for sale. A great deal of effort has gone into the design of display stands to improve appearance and the convenience of use while maintaining structural integrity, as well as economy. The present invention provides an improvement in the construction of a pedestal base for use in connection with display stands and the like and exhibits several objects and advantages, some of which may be summarized as follows: Provides an aesthetically attractive base for a pedestal which is constructed of a minimum number of economically manufactured component parts, which parts are stored and transported easily and conveniently and then are assembled readily, on site, for use at a point of sale; Establishes a sturdy support structure for withstanding the rigors of service in the field without the use of excessively heavy component parts, a multiplicity of supplementary fastener elements, or other features and components which could hinder the ease with which the support structure is manufactured, packaged, transported, stored and then put into use; Enables the use of a minimum number of component parts, which parts are unitary component parts molded of synthetic resin materials for economy of manufacture and for a pleasing appearance, while providing adequate strength, in both the mechanism for assembling the component parts and the completed assembly; Enables quick and easy assembly on site with minimum skills, requiring little time and no assembly tools; Enables quick and easy dismantling upon completion of service at a particular site for ease of removal, relocation or disposal.

The above objects and advantages, as well as further objects and advantages, are attained by the present invention, which may be described briefly as an improvement in a readily assembled base for a pedestal having a central post and a plurality of legs radiating from the post to establish a basal support, wherein the central post includes an axially extending tubular wall having a lowermost basal end with a given diameter and wall thickness; and each leg includes a radially extending support portion and an axially extending hub portion, the hub portion having a radially outer, axially extending hub segment, a radially inner axially extending hub sector, and an annular groove segment located radially between the hub segment and the hub sector and having a nominal radial width essentially complementary to the wall thickness of the tubular wall of the central post adjacent the basal end thereof, the circumferential extent of the hub segment, the hub sector and the groove segment being such that upon assembly of the plurality of legs, the hub portions of the legs are abutted to establish a full hub configuration having a fully annular groove for the reception of the basal end of the tubular wall of the central post, and upon insertion of the basal end of the tubular wall of the central post into the fully annular groove, the hub portions will be held assembled in the full hub configuration.

The invention will be understood more fully, while still further objects and advantages will become apparent, in the following detailed description of a preferred embodiment of the invention illustrated in the accompanying drawing, in which.

Figure 1:
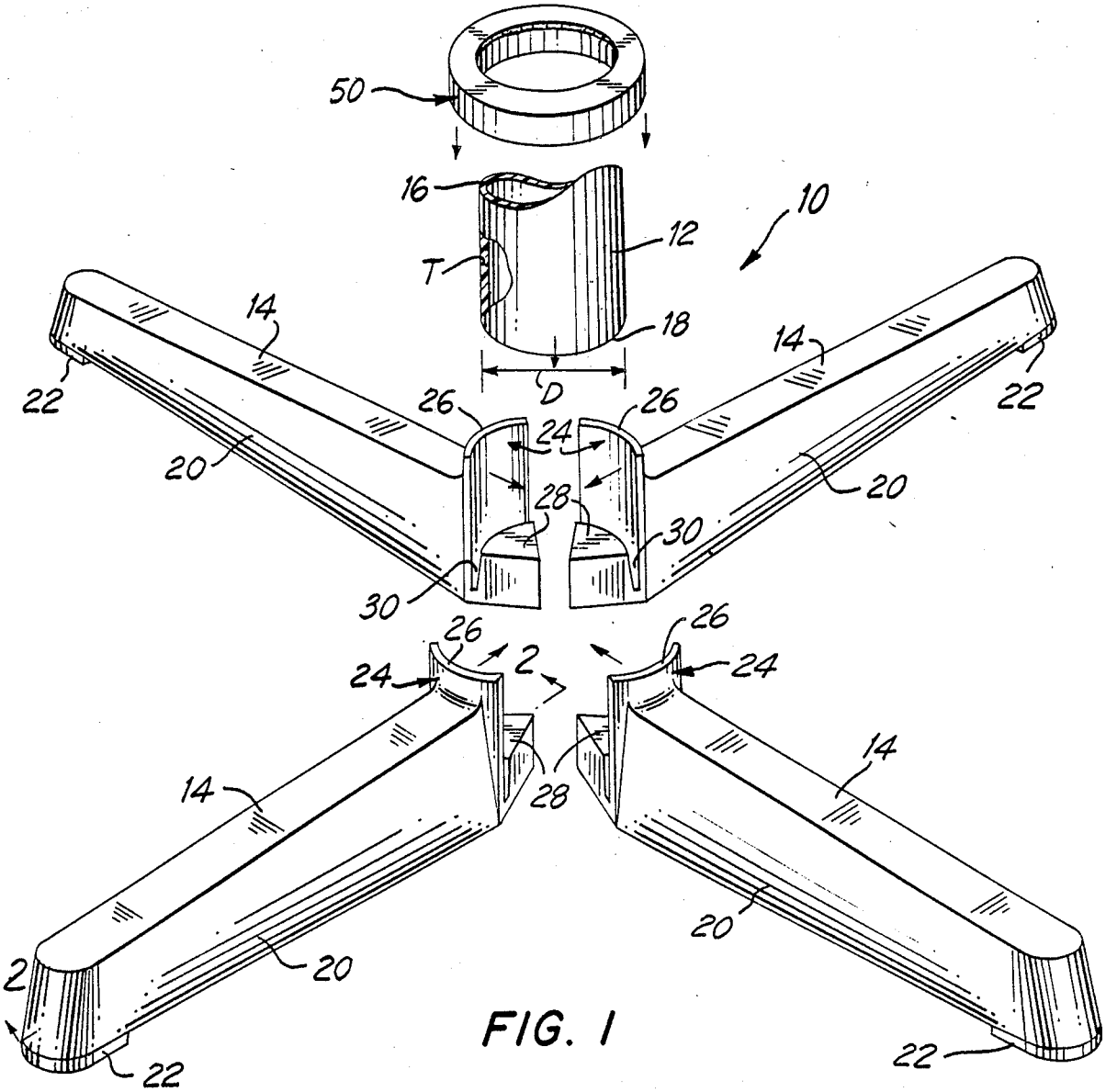
FIG. 1 is an exploded perspective view of a pedestal base constructed in accordance with the present invention.

Referring now to the drawing, and especially to FIG. 1 thereof, a pedestal base constructed in accordance with the invention is illustrated generally at 10 and is seen to include a central post 12 and a plurality of legs 14 radiating from the post 12 to establish a support base for a display (not shown) which is to be attached to the central post 12. The central post includes an axially extending tubular wall 16 having a lowermost basal end 18 with an overall diameter D and a wall thickness T adjacent the basal end 18. Preferably, the central post 12 is constructed of steel tubing, but may be manufactured from any suitable tubular stock material.

Figure 2:
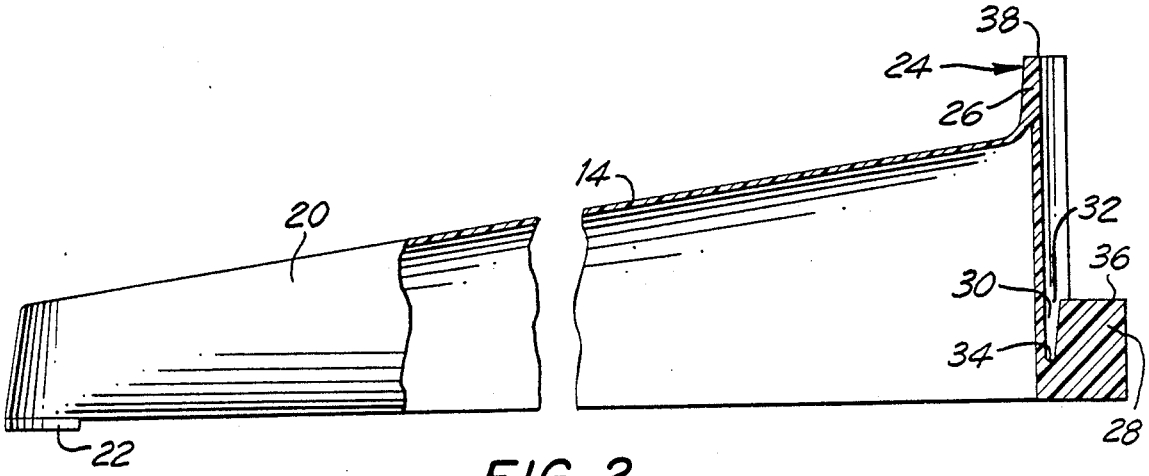
FIG. 2 is a cross-sectional view of one of the legs of the pedestal base, taken along line 2—2 of FIG. 1.

Each leg 14 includes a radially extending support portion 20 having a support foot 22 at the outer extremity thereof. A hub portion 24 is located at the inner end of the leg 14 and includes a radially outer, axially extending hub segment 26, a radially inner, axially extending hub sector 28, and an annular groove segment 30 located radially between the hub segment 26 and the hub sector 28. As best seen in FIG. 2, as well as in FIG. 1, the groove segment 30 has a tapered profile configuration; that is, the groove segment 30 tapers from a wider width at an uppermost open mouth 32 to a narrower width at the bottom 34 of the groove segment 30. The hub sector 28 extends axially upward to a crown 36, and the hub segment 26 extends upwardly well beyond the crown 36 to an uppermost end 38 spaced axially upwardly from the crown 36. Each leg 14 preferably is a unitary construction, molded of a synthetic resin material of suitable strength and appearance, such as a polystyrene.

Figure 3:
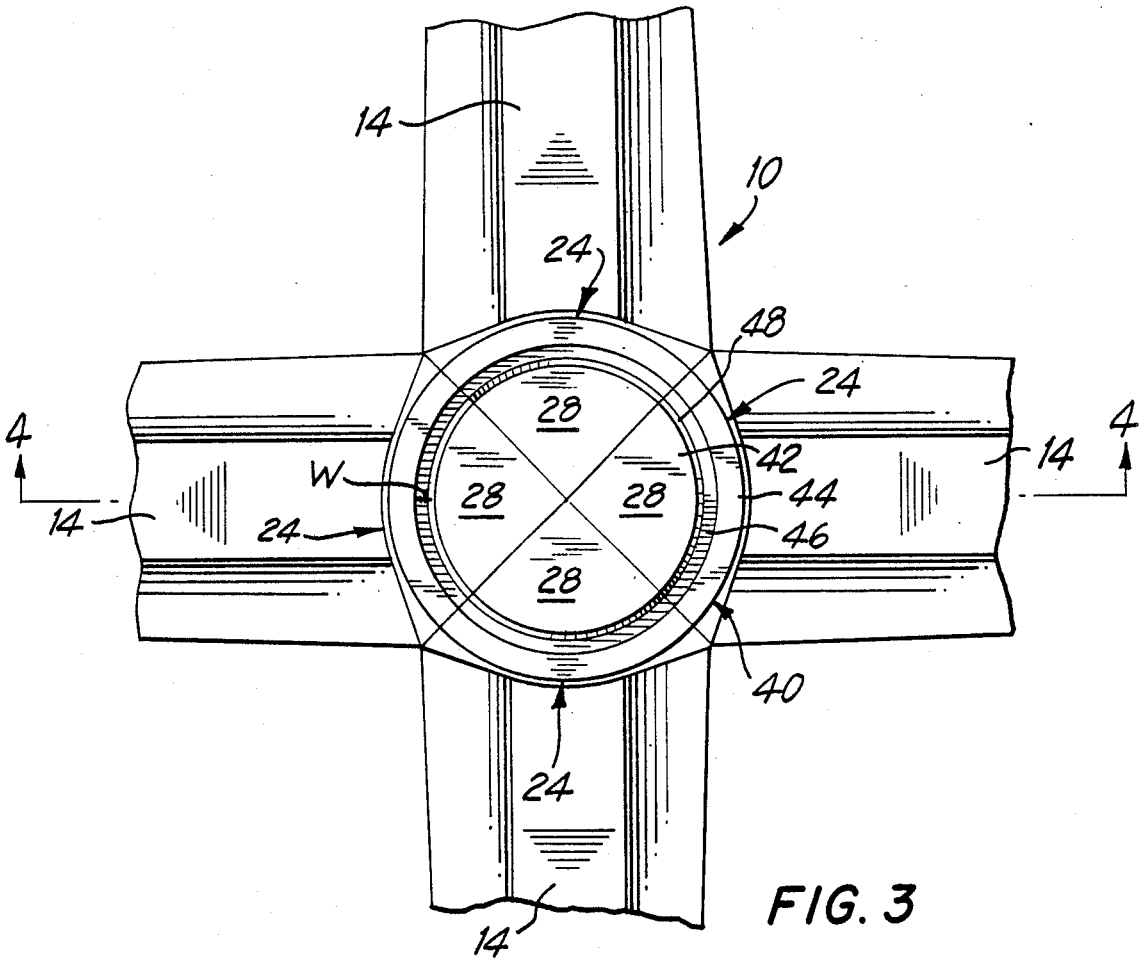
FIG. 3 is a top plan view of the legs of the pedestal base in assembled configuration.

Turning now to FIG. 3, upon assembly of the pedestal base 10, the hub portions 24 are brought together into abutting relationship, the generally wedge-shaped configuration of each hub portion 24 being such that the hub portions 24, when so abutted, establish a full hub 40 having an inner cylindrical plug 42 formed by the joined hub sectors 28, an outer cylindrical sleeve 44 formed by the joined hub segments 26, and an annular groove 46 formed by the joined groove segments 30 and located between the sleeve 44 and the plug 42. In the illustrated embodiment, the pedestal base 10 includes four legs 14 and the hub portions 24 each have a circumferential extent of ninety degrees so that the full hub 40 is completed throughout a full three-hundred-sixty degrees by abutting the four hub portions 24 with one another.

Figure 4:
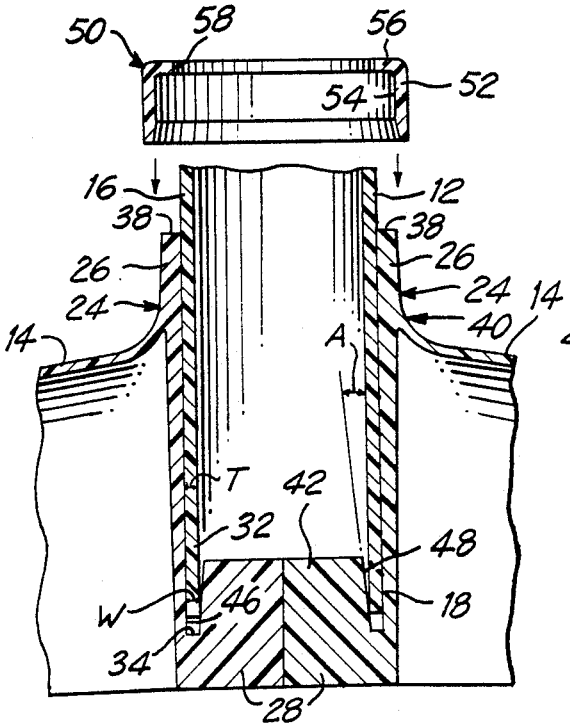
FIG. 4 is an enlarged fragmentary cross-sectional view taken along line 4—4 of FIG. 3, with added component parts.

Once the hub portions 24 are abutted, as illustrated in FIG. 3, the basal end 18 of the tubular wall 16 is inserted into the annular groove 46 established by the four groove segments 30, as shown in FIG. 4. The nominal width W of the groove 46 is somewhat less than the wall thickness T of the tubular wall 16 at the basal end 18, the taper of the groove 46 providing the open mouth 32 with a width slightly larger than the wall thickness T so as to facilitate the insertion, and a width at the bottom 34 somewhat narrower than the wall thickness T so as to tend to wedge the basal end 18 of the post 12 within the groove 46 and maintain the hub portions 24 in the desired assembled arrangement. It is noted that the wedge-shaped cross-sectional configuration of groove 46 includes a peripheral surface 48 of the plug 42, and the peripheral surface 48 is tapered radially inwardly in an axially upward direction, at an acute angle A, so that upon wedging of the basal end 18 of the post within the groove 46, the tubular wall 16 of the post 12 urges the hub portions 24 radially inwardly to maintain and hold the hub portions 24 tightly within the full hub 40. Thus, the legs 14 are assembled adjacent the basal end 18 of the central post 12 and secured there to provide the pedestal base 10.

Figure 5:
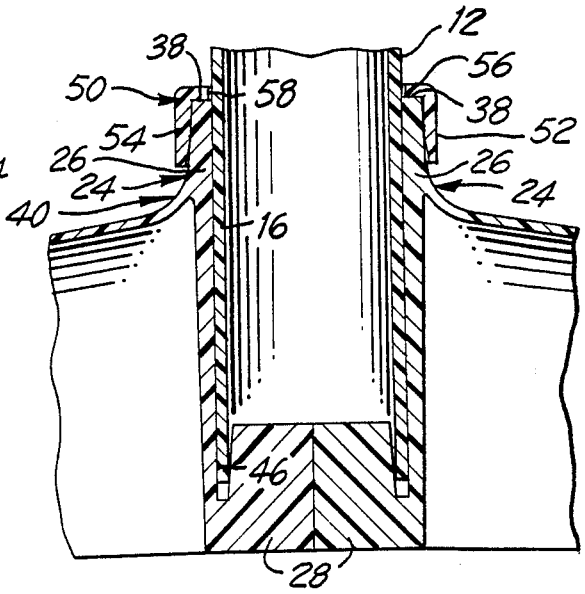
FIG. 5 is a fragmentary view similar to FIG. 4, with the component parts in fully assembled arrangement.

In order to further secure the legs 14 adjacent the basal end 18 of the tubular wall 16, a locking collar 50 is slipped over the post 12 and moved downwardly over the assembled hub portions 24. Referring now to FIG. 5, as well as to FIG. 4, locking collar 50 is in the form of an annular ring 52 which is placed over the hub segments 26 and includes an axial sleeve portion 54 and a radial flange portion 56. The relative dimensions of the inner diameter of the sleeve portion 56 and the outer diameter of the hub segments 26 is such that the sleeve portion 56 grips the hub segments 26 to maintain the hub portions 24 in the desired assembled relationship; that is, the inner diameter of the sleeve portion 54 is slightly less than the outer diameter of the hub segments 26 so that the collar 50 grips the full hub 40 in an interference fit. At the same time, the flange portion 56 of the collar 50 is seated upon the uppermost ends 38 of the hub segments 26 and extends radially inwardly to an inner peripheral edge 58 generally complementary to the diameter D of central post 12 to provide an aesthetically pleasing finished appearance, as well as to further secure the collar 50 in place. Preferably, the collar 50 is molded of a suitable synthetic resin material, such as a polystyrene.

It will be seen that the pedestal base 10 is assembled readily in the field for use at almost any site where a display is required. Disassembly is accomplished readily merely by reversing the above-described procedure. Thus, the present invention provides an improvement in a pedestal base which accomplishes the several objects and advantages outlined above, namely, it provides an aesthetically attractive base for a pedestal which is constructed of a minimum number of economically manufactured component parts, which parts are stored and transported easily and conveniently and then are assembled readily, on site, for use at a point of sale; establishes a sturdy support structure for withstanding the rigors of service in the field without the use of excessively heavy component parts, a multiplicity of supplementary fastener elements, or other features and components which could hinder the ease with which the support structure is manufactured, packaged, transported, stored and then put into use; enables the use of a minimum number of component parts, which parts are unitary component parts molded of synthetic resin materials for economy of manufacture and for a pleasing appearance, while providing adequate strength, in both the mechanism for assembling the component parts and the completed assembly; enables quick and easy assembly on site with minimum skills, requiring little time and no assembly tools; and enables quick and easy dismantling upon completion of service at a particular site for ease of removal, relocation or disposal.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a readily assembled base for a pedestal having a central post and a plurality of legs radiating from the post to establish a basal support, the improvement wherein:

the central post includes an axially extending tubular wall having a lowermost basal end with a given diameter and wall thickness; and each leg includes a radially extending support portion and an axially extending hub portion, the hub portion having a radially outer, axially extending hub segment, a radially inner axially extending hub sector, and an annular groove segment located radially between the hub segment and the hub sector and having a nominal radial width essentially complementary to, the wall thickness of the tubular wall of the central post adjacent the basal end thereof, the circumferential extent of the hub segment, the hub sector and the groove segment being such that upon assembly of the plurality of legs, the hub portions of the legs are abutted to establish a full cylindrical hub configuration having a fully annular groove for the reception of the basal end of the tubular wall of the central post, and upon insertion of the basal end of the tubular wall of the central post into the fully annular groove, the hub portions will be held assembled in the full cylindrical hub configuration.

2. The improvement of claim 1 wherein the annular groove extends axially downwardly into the full cylindrical hub configuration from an open mouth for the reception of the basal end of the tubular wall and is tapered from a radial width at the open mouth slightly larger than the wall thickness of the basal end of the tubular wall to a radial width slightly smaller than the wall thickness of the basal end of the tubular wall such that upon insertion of the basal end of the tubular wall into the annular groove, the tubular wall will be wedged within the annular groove.

3. The improvement of claim 2 wherein the annular groove has a wedge-shaped cross-sectional configuration including an outer peripheral surface on the hub sectors tapered radially inwardly in the axial direction from the smaller radial width toward the larger radial width, such that upon insertion of the basal end of the tubular wall into the annular groove, the tubular wall will engage the outer peripheral surface and urge the hub portions radially inwardly to maintain and hold the hub portions tightly within the full cylindrical hub configuration.

4. The improvement of claim 1 wherein the hub sector of the leg has a given axial extent and the hub segment of that leg extends axially beyond the axial extent of the hub sector.

5. The improvement of claim 1 wherein the leg is a unitary structure molded of a synthetic resin material.

6. The improvement of claim 1 including an annular ring for reception radially over the assembled hub segments in the full cylindrical hub configuration, the relative dimensions of the annular ring and the hub segments being such that the annular ring will grip the hub segments to assist in maintaining the hub segments assembled in the full cylindrical hub configuration.

7. The improvement of claim 6 wherein the hub segment includes an uppermost end and the ring comprises an annular collar having an axial sleeve portion for circumferentially surrounding the hub segments of the fully assembled hub configuration and a radial flange portion for seating upon the axially uppermost ends of the hub segments in the fully assembled hub configuration.

8. The improvement of claim 7 wherein the annular groove extends axially downwardly into the hub configuration from an open mouth for the reception of the basal end of the tubular wall and is tapered from a radial width at the open mouth slightly larger than the wall thickness of the basal end of the tubular wall to a radial width slightly smaller than the wall thickness of the basal end of the tubular wall such that upon insertion of the basal end of the tubular wall into the annular groove, the tubular wall will be wedged within the annular groove.

9. The improvement of claim 8 wherein the annular groove has a wedge-shaped cross-sectional configuration including an outer peripheral surface on the hub sectors tapered radially inwardly in the axial direction from the smaller radial width toward the larger radial width, such that upon insertion of the basal end of the tubular wall into the annular groove, the tubular wall will engage the outer peripheral surface and urge the hub portions radially inwardly to maintain and hold the hub portions tightly within the full cylindrical hub configuration.

10. The improvement of claim 7 wherein the hub sector of the leg has a given axial extent and the hub segment of that leg extends axially beyond the axial extent of the hub sector.

11. The improvement of claim 7 wherein the leg is a unitary structure molded of a synthetic resin material.

* * * * *